US008289257B1

(12) United States Patent
Simon

(10) Patent No.: US 8,289,257 B1
(45) Date of Patent: Oct. 16, 2012

(54) REDUCED SWING DIFFERENTIAL PRE-DRIVE CIRCUIT

(75) Inventor: Daniel L. Simon, Glendale, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 979 days.

(21) Appl. No.: 11/443,798

(22) Filed: May 30, 2006

(51) Int. Cl.
*G09G 3/36* (2006.01)

(52) U.S. Cl. ..... 345/99; 330/69

(58) Field of Classification Search ..... None
See application file for complete search history.

(56) References Cited

U.S. PATENT DOCUMENTS 6,118,438 A * 9/2000 Ho ..... 345/204
6,281,715 B1 * 8/2001 DeClue et al. ..... 327/65
6,608,401 B1 * 8/2003 Walter ..... 307/39
2007/0139301 A1 * 6/2007 Fryer ..... 345/3.4
* cited by examiner

*Primary Examiner* — Alexander Eisen
*Assistant Examiner* — Robin Mishler
(74) *Attorney, Agent, or Firm* — Alan A. R. Cooper; Wade James Brady, III; Frederick J. Telecky, Jr.

(57) ABSTRACT

A circuit for reducing and offsetting the voltage swing of a differential pre-drive circuit. The circuit includes a first H-bridge of transistors receiving a differential pair of input signals. A swing resister is coupled to the H-bridge for reducing a voltage swing of the differential pair of input signals. The reduced swing is generated as a differential pair of output signals. Also, the differential pre-drive circuit includes an offset resistor that is coupled to the H-bridge. The offset resistor acts to offset the differential pair of output signals. As such, the differential pair of output signals having reduced swing and offset as applied to gates of output transistors in an output stage allow the output transistors to remain in the saturation operating state.

9 Claims, 5 Drawing Sheets

REDUCED SWING DIFFERENTIAL PRE-DRIVE CIRCUIT

BACKGROUND OF THE INVENTION

1. Field of the Invention

Embodiments of the present invention relate to the field of timing controllers. More particularly, embodiments of the present invention relate generally to a differential pre-drive circuit exhibiting reduced swing and offset.

2. Related Art

Liquid crystal displays (LCDs) are important to the television market. However, pushing LCDs to the next generation by simply scaling existing LCD monitor panels to wider formats (e.g., 16:9 HDTV) and larger formats is a complicated endeavor. A number of television requirements push beyond conventional state-of-the art monitors. For instance, response time, brightness, contrast, color envelope, color temperature, and progressive scan-and-hold issues require a re-engineering of the monitor solution.

Specifically, LCD televisions bring forward a completely new set of challenges that are broader than simple data signaling issues. The demand for up to HDTV formats (1920×1080) on display sizes beyond 50 inches are problematic. For example, longer transmission distances (due to larger display sizes) and higher data rates (due to larger pixel formats) combine to push clock and data registration beyond stable limits.

In particular, conventional transmitter designs have limited maximum operating frequencies and less than ideal output waveforms exhibiting overshoot and undershoot disturbances. In a pre-drive circuit of conventional transmitter designs, data channels between a timing controller and a column driver are driven by complementary-symmetric metal oxide semiconductor (CMOS) logic. That is, output devices in the transmitter are driven with rail-to-rail CMOS signaling. As a result, this type of pre-drive limits the maximum frequency of the transmitter and correspondingly the data channel. This limitation occurs since it takes time to charge and discharge the channels of the output transistors. In addition, this type of pre-drive creates glitches in the output waveform because the channels of the transistors in the output stage are completely charged and discharged as they leave and re-enter the saturated operating mode. Specifically, as the charge is removed and replaced, glitches appear in the output waveform through capacitive coupling.

SUMMARY OF THE INVENTION

Accordingly, various embodiments of the present invention disclose a pre-drive circuit with reduced swing and offset. Embodiments of the present invention are capable of achieving higher operating frequencies over conventional transmitter designs. In addition, embodiments of the present invention describe transistors in an output stage that are driven by a reduced swing and offset pre-drive circuit that exhibits output waveforms that do not exhibit glitches (e.g., overshoot and undershoot disturbances) due to capacitive coupling.

Specifically, in one embodiment, a circuit for reducing and offsetting the voltage swing of a differential pre-drive circuit is described. The circuit comprises a first H-bridge of transistors receiving a differential pair of input signals. A swing resister is coupled to the H-bridge for reducing a voltage swing of the differential pair of input signals. The reduced swing is exhibited within a differential pair of output signals. Also, the differential pre-drive circuit includes an offset resistor that is coupled to the H-bridge. The offset resistor acts to offset the differential pair of output signals. As such, the differential pair of output signals, having reduced swing and offset, as applied to gates of output transistors in an output stage allow the output transistors to remain in or near the saturation operating state.

In another embodiment, a transmitter of a timing controller communicating over a point-to-point differential signaling (PPDS) data channel is described. The transmitter includes a complementary-symmetry (CMOS) buffer stage providing a differential pair of input signals. The transmitter also comprises a differential pre-drive circuit that is capable of reducing a voltage swing of the differential pair of input signals as generated as a differential pair of output signals. Additionally, the differential pre-drive circuit is capable of offsetting the differential pair of output signals. The transmitter also comprises an output stage that receives the differential pair of output signals. The differential pair of output signals, having reduced swing and offset, as applied to gates of output transistors in an output stage allow the output transistors to remain in or near the saturation operating state resulting in higher switching frequencies and cleaner output waveforms.

DETAILED DESCRIPTION OF THE INVENTION

Figure 1:
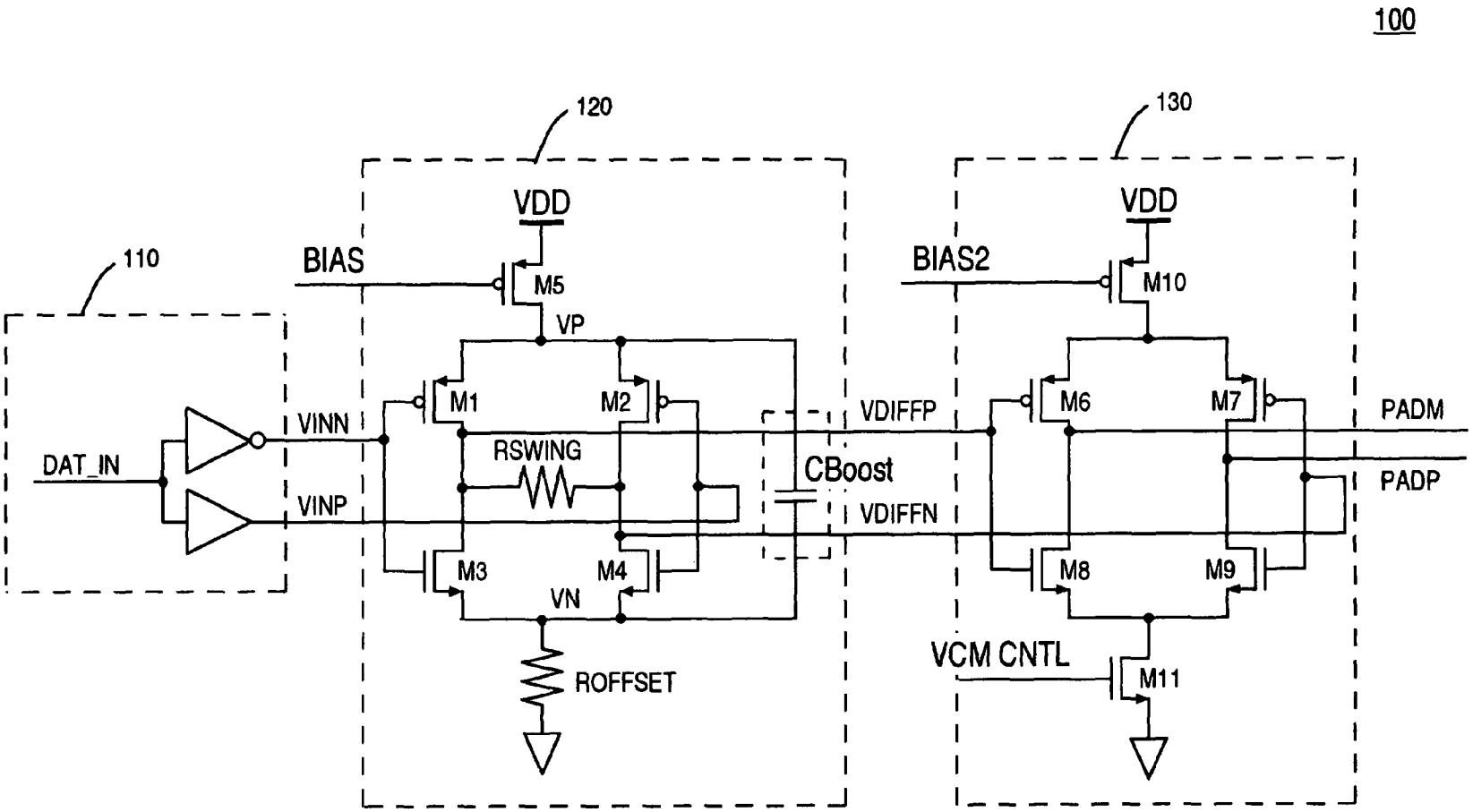
FIG. 1 is a schematic of a transmitter of a timing controller comprising a differential pre-drive circuit with reduced swing and offset communicating over a point-to-point differential signaling (PPDS) data channel, in accordance with one embodiment of the present invention.

Reference will now be made in detail to the preferred embodiments of the present invention, a reduced swing with offset differential pre-drive circuit, examples of which are illustrated in the accompanying drawings.

Accordingly, various embodiments of the present invention disclose a pre-drive circuit with reduced swing and offset. Embodiments of the present invention are capable of achieving higher operating frequencies with lower power requirements over conventional transmitter designs. In addition, embodiments of the present invention describe transistors in an output stage that are driven by a reduced swing and offset pre-drive circuit that exhibits output waveforms that do not exhibit glitches (e.g., overshoot and undershoot disturbances) due to capacitive coupling.

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alphanumeric or alphanumeric designators. Further, while the present invention has been discussed in the context of implementations using discrete electronic circuitry, the functions of any part of such circuitry may alternatively be implemented using one or more appropriately programmed processors, depending upon the signal frequencies or data rates to be processed.

Embodiments of the present invention are implemented within a point-to-point differential signaling (PPDS™) system for communication within a television or high-end monitor. The PPDS™ data signaling system provides a single channel, direct point-to-point link between the timing controller and each column driver of a display device. In one embodiment, PPDS™ is a system of separate, point-to-point links, wherein a single channel is associated with a column driver. This channel carries column-driver control information and digital voltage values that are converted into analog voltages by the column driver. In the PPDS™ system, all the column drivers simultaneously receive their data. As such, even if there is a single differential channel supplying each column driver with data, the channel is used continuously.

Referring now to FIG. 1, a schematic of a transmitter 100 of a timing controller is shown, in accordance with one embodiment of the present invention. In one embodiment, the transmitter 100 communicates with a receiver over a point-to-point differential signaling (PPDS) data channel. The transmitter exhibits high switching frequencies with clean output signals due to a pre-drive circuit with reduced drive and offset.

The transmitter 100 comprises a complementary-symmetry (CMOS) buffer stage 110. The CMOS buffer stage provides a differential pair of input signals, VINN and VINP. The differential pair of input signals is driven rail-to-rail.

In addition, the transmitter 100 comprises a differential pre-drive circuit 120. The pre-drive circuit 120 reduces a voltage swing of the differential pair of input signals, VINN and VINP, as generated as a differential pair of output signals, VDIFFP and VDIFFN. The pre-drive circuit 120 also offsets the differential pair of output signals, VDIFFP and VDIFFN. The pre-drive circuit 120 will be described more fully below in discussion related to FIGS. 2A, 2B, 2C, 3A, 3B, and 3C.

Also, the transmitter 100 comprises an output stage 130 that receives the differential pair of output signals, VDIFFP and VDIFFN. Specifically, output transmitters in the output stage 130 maintain corresponding saturation states or modes of operation since they are driven by the differential pair of output signals that exhibit reduced swing and offset.

In particular, the output stage comprises an H-bridge of output transistors, in accordance with one embodiment of the present invention. The H-bridge of output transistors receives the differential pair of output signals VDIFFP and VDIFFN and outputs differential signals PADM and PADP to a termination resistor for a receiver.

The H-bridge of output transistors comprises a first opposing pair of transistors, M6 and M9, that is coupled to a current source M10 and to ground. M6 is a p-channel metal oxide semiconductor (PMOS) that is driven by VDIFFP. M9 is an n-channel metal oxide semiconductor (NMOS) that is driven by VDIFFN.

The H-bridge of output transistors also comprises a second opposing pair of transistors, M7 and M8 that is also coupled to the current source M10 and to ground. M7 is a PMOS driven by VDIFFN. M8 is an NMOS driven by VDIFFP.

As a result, the transmitter 100 is capable of operating at high frequencies (e.g., greater than 150 MHz), with cleaner output waveform signals, and reduced current consumption at the higher frequencies, in accordance with embodiments of the present invention.

Figure 2A:
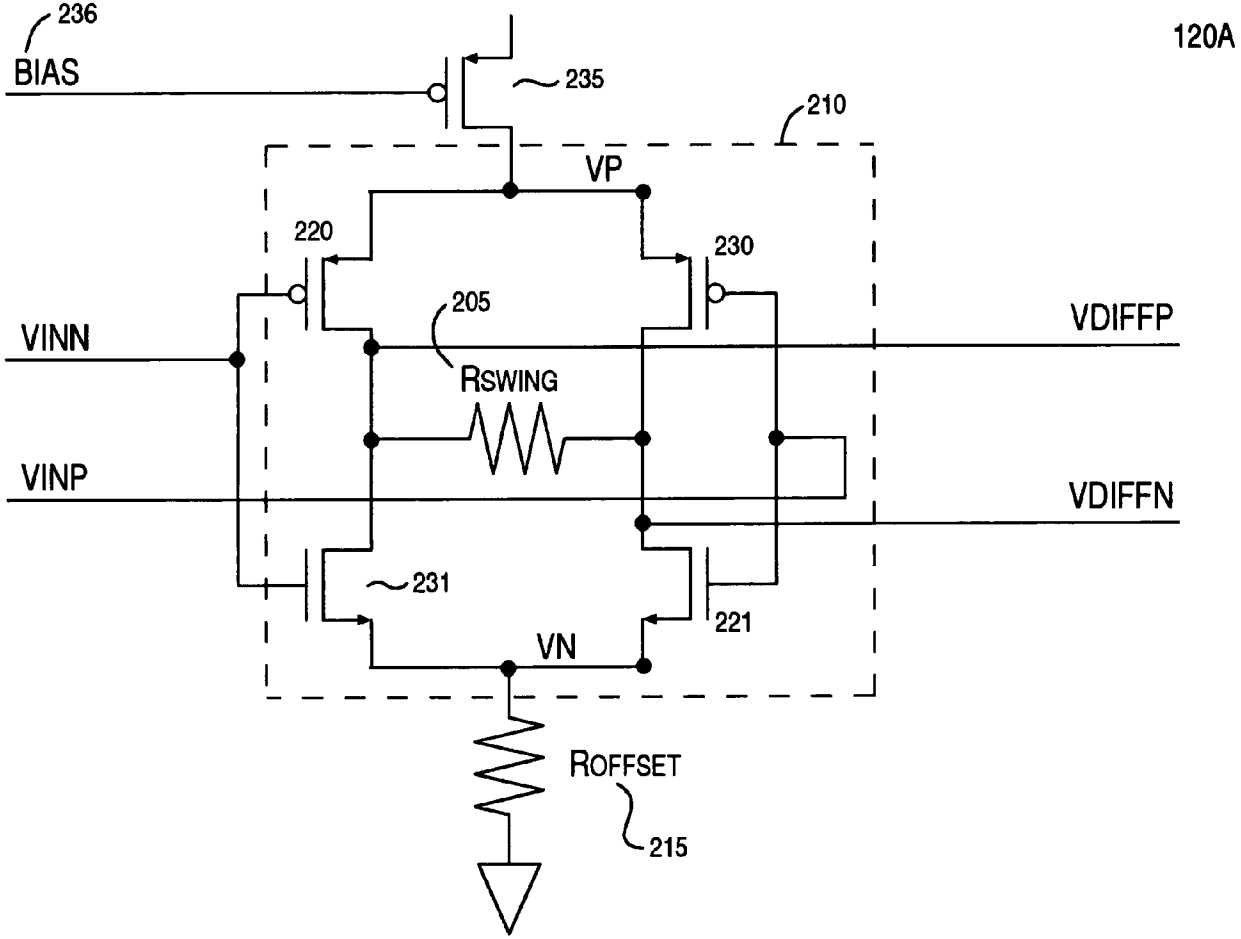
FIG. 2A is a schematic of a differential pre-drive circuit with reduced swing and offset, in accordance with one embodiment of the present invention.

FIG. 2A is a schematic of a differential pre-drive circuit 120A with reduced swing and offset, in accordance with one embodiment of the present invention. The differential pre-drive circuit 120A is analogous to the differential pre-drive circuit 120 of FIG. 1, and as such, like numbered components are intended to perform the same functionality in both FIGS. 1 and 2A.

As shown in FIG. 2A, the differential pre-drive circuit 120A comprises an H-bridge of transistors 210, a swing resistor 205, and an offset resistor 215.

As shown in FIG. 2A, the swing resister 205 is coupled to the H-bridge 210 for reducing a voltage swing of the differential pair of input signals VINN and VINP. The reduced swing is presented through the H-bridge 210 as a differential pair of output signals, VDIFFP and VDIFFN. The differential pair of output signals, VDIFFP and VDIFFN, is taken from opposing ends of the swing resistor 205. Also, the differential pair of output signals, VDIFFP and VDIFFN, exhibit reduced voltage, high frequency, differential signals to drive output transistors of an output stage (e.g., output stage 130 of FIG. 1).

In addition, the offset resistor 215 is coupled to the H-bridge 210 for offsetting the differential pair of output signals, VDIFFP and VDIFFN. The differential pair of output signals, VDIFFP and VDIFFN, having reduced swing and offset maintain saturation states of output transistors in an output stage (e.g., stage 130) of a transmitter, in which the output transmitters are driven by the differential pair of output signals, VDIFFP and VDIFFN. As a result, the transmitter including the differential pre-drive circuit 120A of FIG. 2A exhibits faster operating frequencies, cleaner output waveform signal, and reduced current consumption at the higher frequencies.

Also, in the differential pre-drive circuit 120A, the H-bridge of transistors 210 receives a differential pair of input signals, VINN and VINP, from a CMOS buffer stage, for example. More specifically, the H-bridge 210 comprises a first opposing pair of transistors (220 and 221) coupled together by the swing resistor 205. In addition, the first opposing pair of transistors, 220 and 221, is coupled on one end to a current source 235 controlled by a bias signal 236. The current source 235 provides a bias current to the H-bridge 210. The H-bridge 210 is coupled on an opposite end to the offset resistor 215.

More particularly, the first opposing pair of transistors (220 and 221) comprises a p-channel metal oxide semiconductor (PMOS) 220 that is coupled to a common node, VP. The common node, VP, is also coupled to the current source 235. The PMOS 220 is driven by VINN of the differential pair of input signals, VINP and VINN.

Also, the first opposing pair of transistors (220 and 221) comprises an n-channel metal oxide semiconductor (NMOS) 221 that is coupled to a common node, VN. The common node, VN, is coupled to the offset resistor 215. The NMOS 221 is driven by VINP of the differential pair of input signals, VINP and VINN. Furthermore, drains of the PMOS 220 and the NMOS 221 are coupled together through the swing resistor 205.

The H-bridge 210 also comprises a second opposing pair of transistors, 230 and 231, that is coupled together by the swing resistor 205. The second opposing pair of transistors, 230 and 231, is also coupled to the current source 235 and the offset resistor 215.

In particular, the second opposing pair of transistors, 230 and 231, comprises PMOS 230 and NMOS 231. Drains of the PMOS 230 and NMOS 231 are coupled together through the swing resistor 205. The PMOS 230 is coupled to common node, VP, and is driven by VINP. The NMOS 231 is coupled to common node VN, and is driven by the VINN.

Figure 2B:
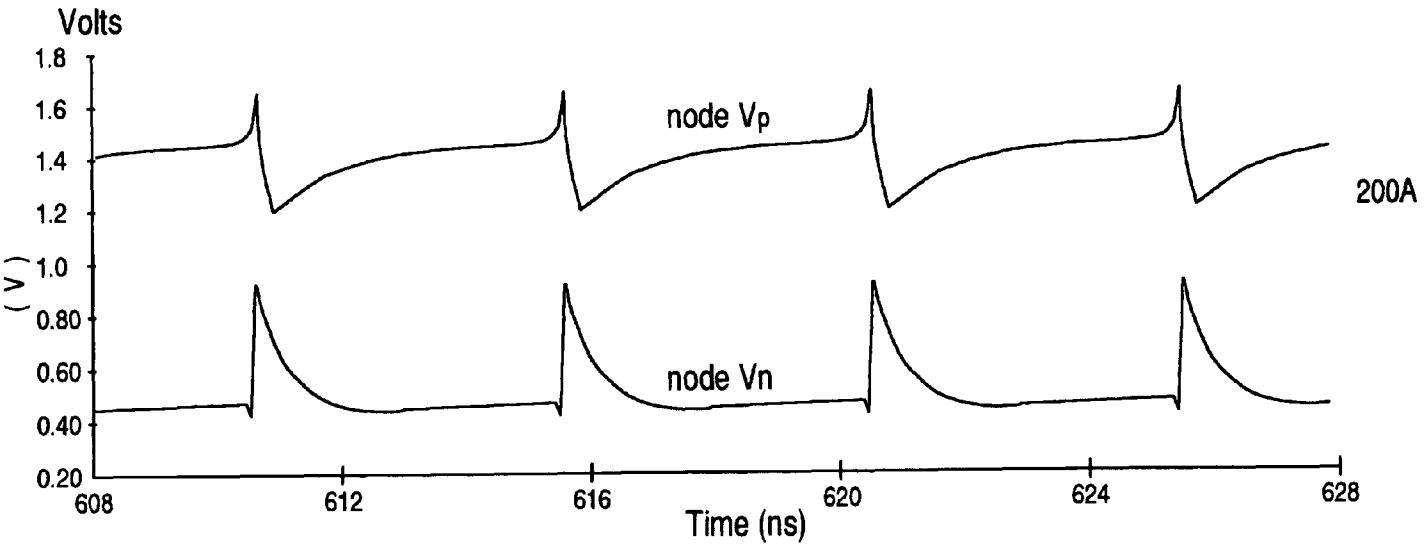
FIG. 2B is a graph illustrating response signals of opposing common nodes within the pre-drive circuit of FIG. 2A, in accordance with one embodiment of the presently claimed invention.
Figure 2C:
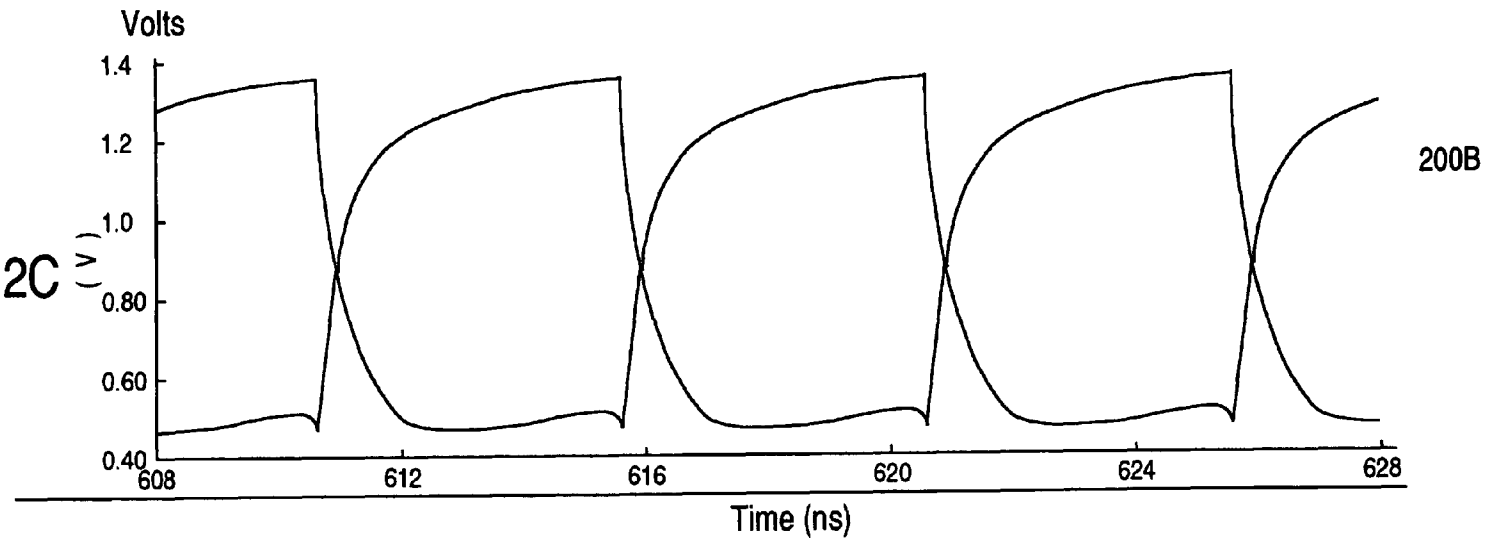
FIG. 2C is a graph illustrating response signals of the differential output signals of the pre-drive circuit of FIG. 2A, in accordance with one embodiment of the presently claimed invention.

FIGS. 2B and 2C are response signals of the differential pre-drive circuit 120A of FIG. 2A, in accordance with embodiments of the present invention. The horizontal axis represents time, and the vertical axis represents voltage.

In particular, FIG. 2B is a graph 200A illustrating response signals of the common nodes, VP and VN, within the differential pre-drive circuit 120A. As shown, the response signals for nodes VP and VN are substantially mirror images of each other.

FIG. 2C is a graph 200B illustrating response signals of the differential output signals VDIFFP and VDIFFN, of the differential pre-drive circuit 120A of FIG. 2A. Of particular note, the switching between the opposing pairs of transistors 220 and 221 and the opposing pairs of transistors 230 and 231 in the H-bridge 210 of FIG. 2A is exhibited by the differential voltage gaps between VP and VN that are the smallest in FIG. 2B. That is, the voltages at VP and VN tend to pull towards each other at the switching points. This is also exhibited by the rising and falling of the VDIFFP and VDIFFN signals in an RC time constant decay curve.

Figure 3A:
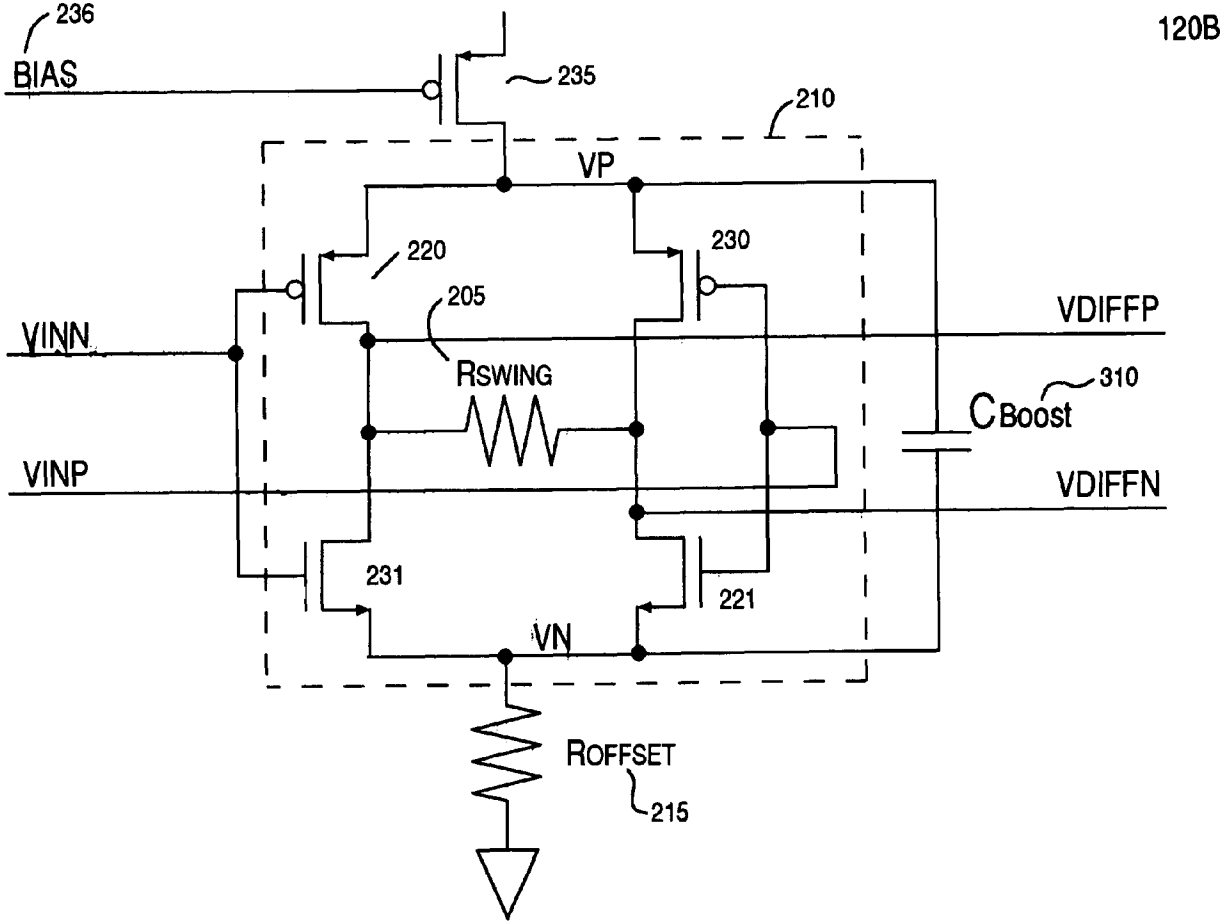
FIG. 3A is a schematic of a differential pre-drive circuit including a charge boost capacitor with reduced swing and offset, in accordance with one embodiment of the present invention.

FIG. 3A is a schematic of a reduced-swing differential pre-drive circuit 120B for generating a high switching frequency with low overhead current, in accordance with one embodiment of the present invention. The differential pre-drive circuit 120B is analogous to the differential pre-drive circuit 120 of FIG. 1 and of differential pre-drive circuit 120A of FIG. 2A, and as such, like numbered components are intended to perform the same functionality in both FIGS. 1, 2A, and 3A. Where applicable, specific discussion of like numbered components is presented when first encountered.

As shown in FIG. 3A, the differential pre-drive circuit 130A comprises an H-bridge of transistors 210 for receiving a differential pair of input signals, VINNP and VINNN. In summary, the H-bridge 210 comprises a first opposing pair of transistors, 220 and 221, and a second opposing pair of transistors, 230 and 231, each of which is coupled to a first common node, VP, and a second common node, VN.

The differential pre-drive circuit also comprises a swing resister 205 that is coupled to the first opposing pair of transistors, 220 and 221, and to the second opposing pair of transistors, 230 and 231. The swing resistor 205 reduces a voltage swing of the differential pair of input signals, VINP and VINN, through the H-bridge 210 as generated as a differential pair of output signals, VDIFFP and VDIFFN.

In addition, the differential pre-drive circuit comprises an offset resistor 215 that is coupled to the H-bridge 215 for offsetting the differential pair of output signals, VDIFFP and VDIFFN. As such, the differential pair of output signals having reduced swing and offset maintain saturation states of output transistors that are driven by the differential pair of output signals in an output stage.

Additionally, the differential pre-drive circuit 210 comprises a charge boost capacitor 310 coupled to common node VP and common node VN. The charge boost capacitor distinguishes the pre-drive 120B from the pre-drive of FIG. 2A. The charge boost capacitor is responsible for generating the high switching frequency out of the differential pre-drive circuit 120B with low overhead current. That is, instead of increasing the bias current 236 to achieve faster switching times for the differential pre-drive circuit 120B, the charge boost capacitor 310 is used.

In one embodiment, the charge boost capacitor 310 keeps a potential difference between the nodes, VP and VN, relatively constant. As a result, during switching charge is removed from the charge boost capacitor 310 and becomes extra boost current to node VP, thereby ramping the transistors in the H-bridge 210 much faster. This, in turn, pulls the output transistors of an output stage to the desired level much faster.

As such, faster rise/fall times of the differential outputs, VDIFFP and VDIFFN, of the differential pre-drive circuit 120B is achieved without increasing the overhead current, BIAS 236. This results in faster operating frequencies for the transmitter of a timing controller, for example.

Figure 3B:
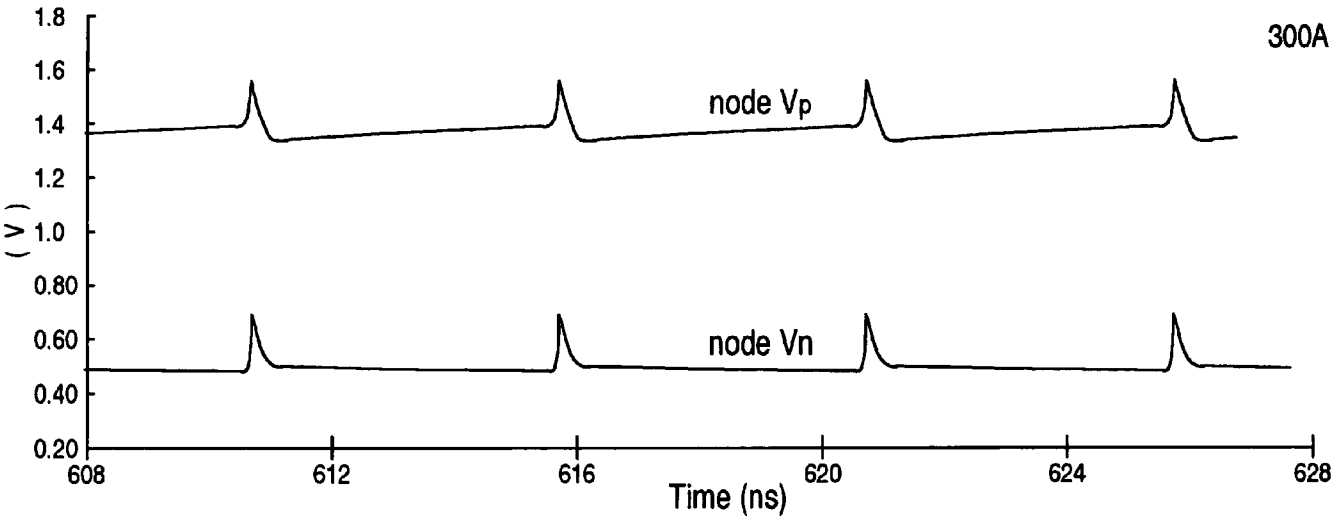
FIG. 3B is a graph illustrating response signals of opposing common nodes within the pre-drive circuit of FIG. 3A, in accordance with one embodiment of the presently claimed invention.
Figure 3C:
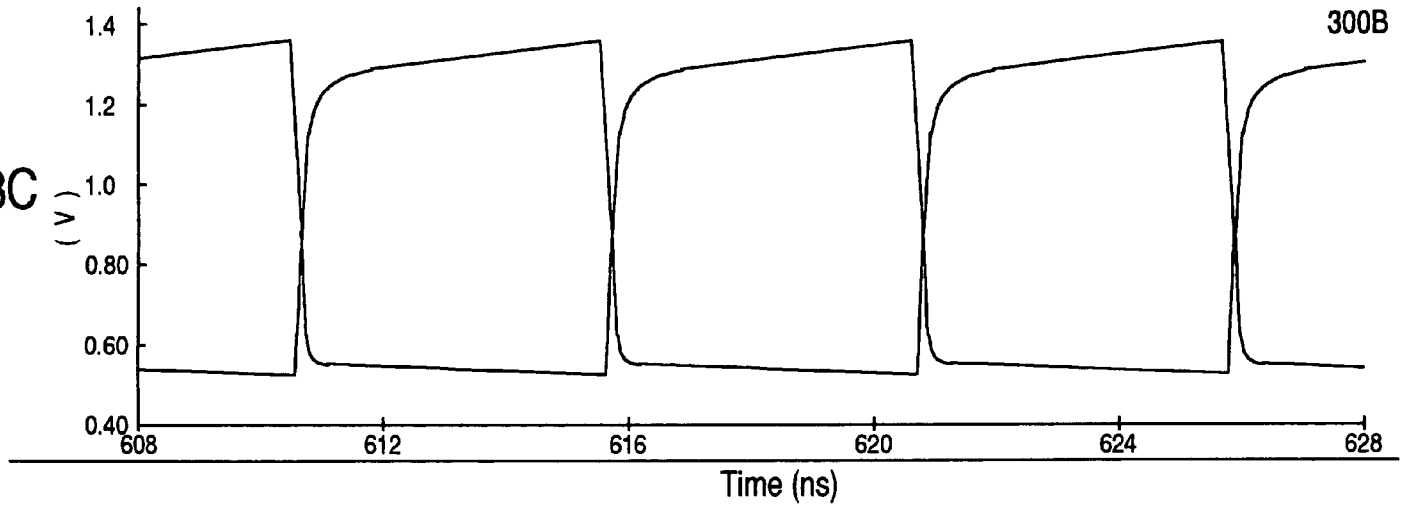
FIG. 3C is a graph illustrating response signals of the differential output signals of the pre-drive circuit of FIG. 3A, in accordance with one embodiment of the presently claimed invention.

FIGS. 3B and 3C are response signals of the differential pre-drive circuit 120B of FIG. 3A, in accordance with embodiments of the present invention. The horizontal axis represents time, and the vertical axis represents voltage.

In particular, FIG. 3B is a graph 300A illustrating response signals of the common nodes, VP and VN, within the differential pre-drive circuit 120B. As shown, the response signals for nodes VP and VN are relatively constant, even when the transistors are switching. Because of the charge boost capacitor 310, the voltages of VP and VN are no longer mirrored, but substantially similar in response. As such, there is less voltage potential difference during switching between nodes VP and VN.

FIG. 3C is a graph 300B illustrating response signals of the differential output signals VDIFFP and VDIFFN, of the differential pre-drive circuit 120B of FIG. 3A. Of particular note, the switching between the opposing pairs of transistors 220 and 221 and the opposing pairs of transistors 230 and 231 in the H-bridge 210 of FIG. 2B is exhibited by the peaks in VP and VN of FIG. 3B. Furthermore, the rise and fall times of the differential output signals, VDIFFP and VDIFFN, of FIG. 3C ramps much faster than the response curve of FIG. 2C, in which a pre-drive circuit without the charge boost capacitor is shown. That is, the rise and fall times of the differential output signals, VDIFFP and VDIFFN, of FIG. 3C is more like a square wave, as opposed to the RC time constant delay shape of the pre-drive circuit without a charge boost capacitor in FIG. 2C.

Accordingly, various embodiments of the present invention disclose a pre-drive circuit with reduced swing and offset. Embodiments of the present invention are capable of achieving higher operating frequencies over conventional transmitter designs. In addition, embodiments of the present invention achieve faster switching of transistors through faster rise and fall times of the pre-drive outputs without increasing overhead current, which results in faster operating frequencies for the transmitter over a data channel.

Embodiments of the present invention, a pre-drive circuit with reduced swing and offset are described. While the invention is described in conjunction with the preferred embodiments, it is understood that they are not intended to limit the invention to these embodiments. On the contrary, the invention is intended to cover alternatives, modifications and equivalents, which may be included within the spirit and scope of the invention as defined by the appended claims. Furthermore, in the detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

What is claimed is:

1. A reduced-swing differential pre-drive and output stage circuit, comprising:

a complementary-symmetry (CMOS) buffer stage providing a differential pair of input signals;

a first H-bridge of transistors receiving the differential pair of input signals, the first H-bridge including:

a swing resistor coupled to said H-bridge for reducing a voltage swing of said differential pair of input signals through said H-bridge as generated as a differential pair of output signals; and an internal offset resistor coupled to said H-bridge for offsetting said differential pair of output signals such that said differential pair of output signals having reduced swing and offset maintain saturation states of output transistors that are driven by said differential pair of output signals in an output stage, wherein said first H-bridge comprises a first opposing pair of transistors and a second opposing pair of transistors, wherein a first input signal and a second input signal of the differential pair of input signals is received by a first transistor and a second transistor, respectively, of each of the first and second opposing pairs of transistors, wherein the first and second transistors of the first opposing pair of transistors are coupled together through the swing resistor, wherein only one transistor of the first opposing pair of transistors is directly coupled to a current source, wherein the first opposing pair of transistors is coupled together by the swing resistor, wherein the first opposing pair of transistors is coupled to a current source and the offset resistor, wherein the first opposing pair of transistors comprises:

a first p-channel metal oxide semiconductor (PMOS) coupled to a first common node that is coupled to the current source, wherein the first PMOS is driven by a first signal of the differential pair of input signals; and a first n-channel metal oxide semiconductor (NMOS) coupled to a second common node that is coupled to the offset resistor, wherein drains of the first PMOS and the first NMOS are coupled together through the swing resistor, wherein the first NMOS is driven by a second signal of the differential pair of input signals, wherein the current source provides a bias current to the first H-bridge, wherein the second opposing pair of transistors are coupled together by the swing resistor, and wherein the second opposing pair of transistors is coupled to the current source and the offset resistor, wherein the output stage includes:

a second H-bridge of the output transistors receiving the differential pair of output signals, the second H-bridge of the output transistors having:

a first opposing pair of transistors coupled to a current source and to ground, wherein the first opposing pair of transistors comprises a first p-channel metal oxide semiconductor (PMOS) coupled to a first n-channel metal oxide semiconductor (NMOS), wherein the first PMOS is driven by a first output signal of the differential pair of output signals and the first NMOS is driven by a second output signal of the differential pair of output signals;

a second opposing pair of transistors coupled to the current source and to the ground, wherein the second opposing pair of transistors comprises a second PMOS coupled to a second NMOS, wherein the second PMOS is driven by the second output signal and the second NMOS is driven by the first output signal.

2. The reduced-swing differential pre-drive and output stage circuit of claim 1, wherein said second opposing pair of transistors comprises:

a second PMOS coupled to said first common node, wherein said second PMOS is driven by said second signal; and a second NMOS coupled to said second common node, wherein drains of said second PMOS and said second NMOS are coupled together through said swing resistor, and wherein said second NMOS is driven by said first signal.

3. The reduced-swing differential pre-drive and output stage circuit of claim 1, wherein said differential pair of output signals is taken from opposing ends of said swing resistor.

4. The reduced-swing differential pre-drive circuit and output stage of claim 1, further comprising:

a charge boost capacitor coupled to said first common node and said second common node for keeping a potential difference between said first common node and said common node relatively constant.

5. A reduced-swing differential pre-drive and output stage circuit, comprising:

a complementary-symmetry (CMOS) buffer stage providing a differential pair of input signals;

a first H-bridge of transistors for receiving the differential pair of input signals, wherein said first H-bridge includes:

a first opposing pair of transistors and a second opposing pair of transistors, each coupled to a first common node and a second common node, wherein a first input signal and a second input signal of the differential pair of input signals is received by a first transistor and a second transistor, respectively, of each of the first and second opposing pairs of transistors;

a swing resistor coupling said first opposing pair of transistors and coupling said second opposing pair of transistors for reducing a voltage swing of said differential pair of input signals through said first H-bridge as generated as a differential pair of output signals, wherein the first and second transistors of the first opposing pair of transistors are coupled together through the swing resistor, and wherein only one transistor of the first opposing pair of transistors is directly coupled to a current source;

an internal offset resistor coupled to said H-bridge for offsetting said differential pair of output signals such that said differential pair of output signals having reduced swing and offset maintain saturation states of output transistors that are driven by said differential pair of output signals in an output stage; and a charge boost capacitor coupled to said first common node and said second common node for keeping a potential difference between said first common node and said second common node relatively constant, wherein said first opposing pair of transistors is coupled to a current source through the first common node, and is coupled to the offset resistor through the second common node, the first opposing pair of transistors including:

a first p-channel metal oxide semiconductor (PMOS) coupled to the first common node, wherein the first PMOS is driven by a first signal of the differential pair of input signals; and a first n-channel metal oxide semiconductor (NMOS) coupled to the second common node, wherein drains of the first PMOS and the first NMOS are coupled together through the swing resistor, and wherein the first NMOS is driven by a second signal of the differential pair of input signals, the output stage having:

a second H-bridge of said output transistors receiving said differential pair of output signals, said second H-bridge of said output transistors including:

a first opposing pair of transistors coupled to a current source and to ground, wherein the first opposing pair of transistors comprises a first p-channel metal oxide semiconductor (PMOS) coupled to a first n-channel metal oxide semiconductor (NMOS), wherein the first PMOS is driven by a first output signal of the differential pair of output signals and the first NMOS is driven by a second output signal of the differential pair of output signals; and a second opposing pair of transistors coupled to the current source and to the ground, wherein the second opposing pair of transistors comprises a second PMOS coupled to a second NMOS, wherein the second PMOS is driven by the second output signal and the second NMOS is driven by the first output signal.

6. The reduced-swing differential pre-drive and output stage circuit of claim 5, wherein said second opposing pair of transistors comprises:

a second PMOS coupled to said first common node, wherein said second PMOS is driven by said second signal; and a second NMOS coupled to said second common node, wherein drains of said second PMOS and said second NMOS are coupled together through said swing resistor, and wherein said second NMOS is driven by said first signal.

7. A transmitter of a timing controller communicating over a point-to-point differential signaling (PPDS) data channel, comprising:

a complementary-symmetry (CMOS) buffer stage providing a differential pair of input signals;

a differential pre-drive circuit for reducing a voltage swing of said differential pair of input signals as generated as a differential pair of output signals and for offsetting said differential pair of output signals, said differential pre-drive circuit including a first H-bridge of transistors receiving said differential pair of input signals, said H-bridge including:

a first opposing pair of transistors and a second opposing pair of transistors, wherein a first input signal and a second input signal of the differential pair of input signals is received by a first transistor and a second transistor, respectively, of each of the first and second opposing pairs of transistors, wherein the first and second transistors of the first opposing pair of transistors are coupled together through a swing resistor, and wherein only one transistor of the first opposing pair of transistors is directly coupled to a current source; and an output stage receiving said differential pair of output signals, wherein output transmitters in said output stage maintain saturation states as driven by said differential pair of output signals that exhibit reduced swing and offset, wherein the swing resistor is coupled to said H-bridge for reducing said voltage swing; and wherein an offset resistor coupled to said H-bridge for offsetting said differential pair of output signals, wherein the swing resistor is coupled to said H-bridge for reducing said voltage swing; and an offset resistor coupled to said H-bridge for offsetting said differential pair of output signals, wherein said first H-bridge further comprises:

said first opposing pair of transistors coupled together by said swing resistor, wherein said first opposing pair of transistors is coupled to a current source through a first common node and to said offset resistor through a second common node, wherein said current source provides a bias current to said first H-bridge;

said second opposing pair of transistors coupled together by said swing resistor, wherein said second opposing pair of transistors is coupled to said first common node and to said second common node wherein said first opposing pair of transmitters comprises:

a first p-channel metal oxide semiconductor (PMOS) coupled to said first common ode, wherein said first PMOS is driven by a first signal of said differential pair of input signals; and a first n-channel metal oxide semiconductor (NMOS) coupled to said second common node, wherein drains of said first PMOS and said first NMOS are coupled together through said swing resistor, and wherein said first NMOS is driven by a second signal of said differential pair of input signals, and an output stage circuit, including:

a second H-bridge of said output transistors receiving said differential pair of output signals, said second H-bridge of said output transistors including:

a first opposing pair of transistors coupled to a current source and to ground said first opposing pair of transistors comprises a first p-channel metal oxide semiconductor (PMOS) coupled to a first n-channel metal oxide semiconductor (NMOS) coupled, wherein said first PMOS is driven by a first output signal of said differential pair of output signals and said first NMOS is driven by a second output signal of said differential pair of output signals; and a second opposing pair of transistors coupled to said current source and to said ground, wherein said second opposing pair of transistors comprises a second PMOS coupled to a second NMOS, wherein said second PMOS is driven by said second output signal and said second NMOS is driven by said first output signal.

8. The transmitter of claim 7, wherein said second opposing pair of transmitters comprises:

a second PMOS coupled to said first common node, wherein said second PMOS is driven by said second signal; and a second NMOS coupled to said second common node, wherein drains of said second PMOS and said second NMOS are coupled together through said swing resistor, and wherein said second NMOS is driven by said first signal.

9. The transmitter of claim 7, wherein said differential pair of output signals is taken from opposing ends of said swing resistor.

* * * * *